US011359509B1

(12) United States Patent
O'Brien

(10) Patent No.: US 11,359,509 B1
(45) Date of Patent: Jun. 14, 2022

(54) VARIABLE GUIDE VANE ASSEMBLY WITH BUSHING RING AND BIASING MEMBER

(71) Applicant: PRATT & WHITNEY CANADA CORP., Longueuil (CA)

(72) Inventor: James O'Brien, Hamilton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/101,727

(22) Filed: Nov. 23, 2020

(51) Int. Cl.
*F01D 11/14* (2006.01)
*F01D 9/04* (2006.01)

(52) U.S. Cl.
CPC ..... *F01D 11/14* (2013.01); *F01D 9/04* (2013.01); *F05D 2220/32* (2013.01); *F05D 2240/12* (2013.01); *F05D 2240/55* (2013.01)

(58) Field of Classification Search
CPC . F01D 11/14; F01D 9/04; F01D 9/041; F01D 5/148; F01D 17/162; F04D 29/563; F05D 2240/12; F05D 2240/55; F05D 2220/32
See application file for complete search history.

(56) References Cited

U.S. PATENT DOCUMENTS 5,328,327 A * 7/1994 Naudet ..... F04D 29/563 415/160
8,328,512 B2 * 12/2012 Major ..... F01D 17/162 415/209.4
8,500,394 B2 * 8/2013 Major ..... F01D 17/162 415/160
9,533,485 B2 * 1/2017 Marshall ..... F01D 17/162
10,494,944 B2 * 12/2019 Humhauser ..... F01D 17/162
10,626,742 B2 * 4/2020 Albers ..... F01D 25/162
2008/0219832 A1 * 9/2008 Major ..... F01D 17/162 415/65
2014/0140822 A1 * 5/2014 Capozzi ..... F01D 9/00 415/160

* cited by examiner

*Primary Examiner* — Courtney D Heinle
*Assistant Examiner* — Ryan C Clark
(74) *Attorney, Agent, or Firm* — Norton Rose Fulbright Canada LLP

(57) ABSTRACT

A gas turbine engine has: a first component and a second component defining a respective first gaspath surface and a second gaspath surface of an annular gaspath, the first and second gaspath surfaces axially spaced apart from one another by an annular recess in the first component; a bushing ring disposed within the annular recess and defining stem pockets therein; variable guide vanes pivotable about respective vane axes extending between first and second stems; and a biasing member received within the annular recess and disposed axially between the bushing ring and one of the first component and the second component, the biasing member exerting a force against the bushing ring in an axial direction relative to the central axis and towards the other of the first component and the second component.

20 Claims, 3 Drawing Sheets

VARIABLE GUIDE VANE ASSEMBLY WITH BUSHING RING AND BIASING MEMBER

TECHNICAL FIELD

The disclosure relates generally to gas turbine engines, and more particularly to variable guide vane assemblies as may be present in a compressor section of a gas turbine engine.

BACKGROUND

In a gas turbine engine, air is pressurized by rotating blades within a compressor, mixed with fuel and then ignited within a combustor for generating hot combustion gases, which flow downstream through a turbine for extracting energy therefrom. Within the compressor of the engine, the air is channeled through circumferential rows of vanes and blades that pressurize the air in stages. Variable guide vanes (VGVs) are sometimes used within compressors, and provide vanes which are rotatable such that the angle of attack they define with the incoming flow may be varied. Improvements with such variable guide vane assemblies is sought.

SUMMARY

In one aspect, there is provided a gas turbine engine comprising: a first component and a second component defining a respective first gaspath surface and a second gaspath surface of an annular gaspath extending circumferentially around a central axis, the first and second gaspath surfaces axially spaced apart from one another by an annular recess in the first component; a bushing ring disposed within the annular recess and defining stem pockets therein, the stem pockets circumferentially distributed about the central axis; variable guide vanes circumferentially distributed about the central axis, the variable guide vanes having airfoils extending across the annular gaspath, the variable guide vanes having first and second stems located at first and second radial ends of the airfoils, the first stems rotatably engaged within the stem pockets in the bushing ring, the variable guide vanes pivotable about respective vane axes extending between the first and second stems; and a biasing member received within the annular recess and disposed axially between the bushing ring and one of the first component and the second component, the biasing member exerting a force against the bushing ring in an axial direction relative to the central axis and towards the other of the first component and the second component.

In some embodiments, the biasing member is a sealing member.

In some embodiments, the sealing member extends circumferentially all around the central axis.

In some embodiments, the biasing member is a U-seal.

In some embodiments, the biasing member is a W-seal.

In some embodiments, the sealing member is made of an elastomeric material.

In some embodiments, the bushing ring has two body portions biased in engagement against one another via the biasing member.

In some embodiments, the first and second gaspath surfaces are disposed on a radially inner annular surface of the annular gas path.

In some embodiments, the first component is an inner casing of the gas turbine engine and wherein the second component is a wall of a seal housing of the gas turbine engine.

In some embodiments, the annular recess is defined by a first section of the inner casing having a diameter less than that of a second section of the inner casing, a shoulder at an intersection between the first section and the second section, the bushing ring in abutment against the shoulder.

In some embodiments, the biasing member is located axially between the bushing ring and a distal end of the wall of the seal housing.

In some embodiments, the wall of the seal housing axially overlaps the first section of the inner casing.

In some embodiments, the distal end of the wall of the seal housing defines a face extending around the central axis and facing the biasing member, the face sloping away from the bushing ring in a radial direction away from the annular gaspath.

In some embodiments, the variable guide vanes are located within a compressor of the gas turbine engine.

In some embodiments, the variable guide vanes are located at an inlet of the compressor.

In some embodiments, the biasing member is located downstream of the bushing ring relative to a flow direction in the annular gaspath.

In some embodiments, the bushing ring defines a third gaspath surface, the first, second and third second gaspath surfaces collectively defining an annular surface of the annular gaspath.

In another aspect, there is provided a gas turbine engine comprising: a first component and a second component defining a respective first gaspath surface and a second gaspath surface of an annular gaspath extending circumferentially around a central axis, the first and second gaspath surfaces axially spaced apart from one another by an annular recess in the first component; a bushing ring disposed within the annular recess and defining stem pockets therein, the stem pockets circumferentially distributed about the central axis; variable guide vanes circumferentially distributed about the central axis, the variable guide vanes having airfoils extending across the annular gaspath, the variable guide vanes having first and second stems located at first and second radial ends of the airfoils, the first stems rotatably engaged within the stem pockets in the bushing ring, the variable guide vanes pivotable about respective vane axes extending between the first and second stems; and means for exerting a force against the bushing ring in an axial direction relative to the central axis.

In some embodiments, the means include an elastomeric sealing member received within the annular recess, the elastomeric sealing member located between the bushing ring and one of the first component and the second component.

In another aspect, there is provided a gas turbine engine comprising: an annular gaspath extending circumferentially around a central axis, the annular gaspath defined radially between a first gaspath surface and a second gaspath surface; two walls defining a portion of the first gaspath surface, the two walls axially spaced apart from one another by a spacing; a stator having vanes circumferentially distributed about a central axis, the vanes having airfoils extending across the annular gaspath, the vanes having first and second stems secured to first and second radial ends of the airfoils, the vanes pivotable about respective vane axes extending between the first and second stems a bushing ring radially supported by one or both of the two walls within the spacing between the two walls, the bushing ring defining pockets receiving the first stems of the vanes, the bushing ring rotatably supporting the first stems of the vanes; and a biasing member received within a gap between the bushing ring and one of the two walls, the biasing member axially compressed between the bushing ring and the one of the two walls.

In yet another aspect, there is provided a method of assembling a section of a gas turbine engine, comprising: obtaining two walls defining a gaspath surface of an annular gaspath of the gas turbine engine, the two walls extending circumferentially about a central axis a bushing ring, a biasing member, and vanes of a stator of the section of the gas turbine engine; mounting the bushing ring on a first wall of the two walls; mounting the biasing member on the first wall; engaging stems of the vanes into pockets defined by the bushing ring to allow the vanes to rotate about respective vane axes; and mounting a second wall of the two walls around a portion of the first wall and axially moving the two walls toward one another until the biasing member is compressed between the bushing ring and one of the two walls.

BRIEF DESCRIPTION OF THE DRAWINGS

Reference is now made to the accompanying figures in which.

DETAILED DESCRIPTION

The following disclosure relates generally to gas turbine engines, and more particularly to assemblies including one or more struts and variable orientation guide vanes as may be present in a compressor section of a gas turbine engine. In some embodiments, the assemblies and methods disclosed herein may promote better performance of gas turbine engines, such as by improving flow conditions in the compressor section in some operating conditions, improving the operable range of the compressor, reducing energy losses and aerodynamic loading on rotors.

Figure 1:
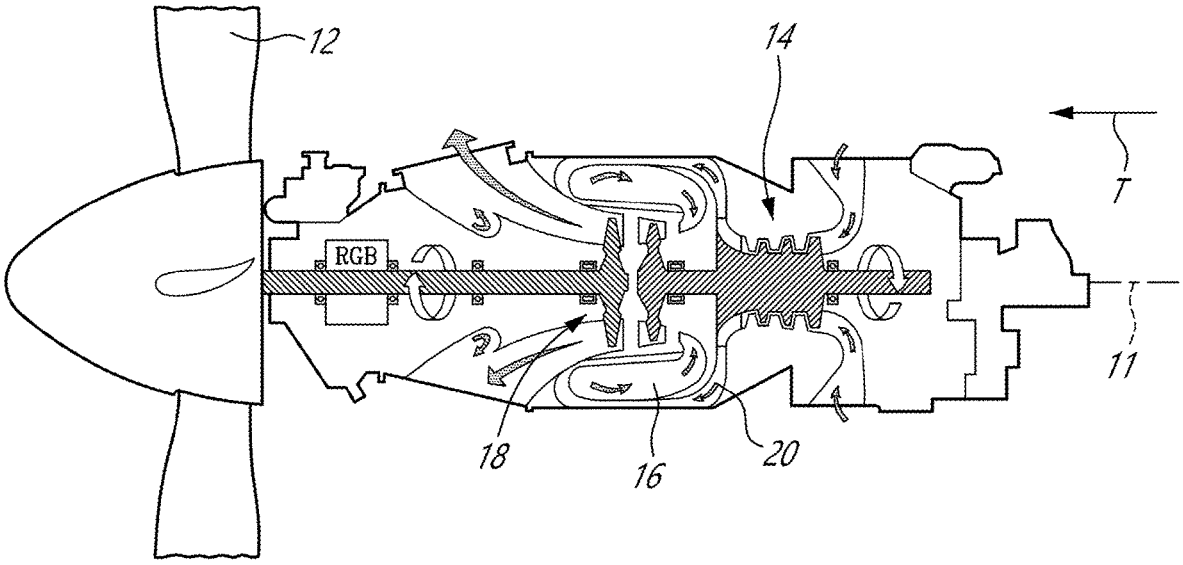
FIG. 1 is a schematic cross-sectional view of a gas turbine engine.

FIG. 1 illustrates a gas turbine engine 10 (in this case, a turboprop) of a type preferably provided for use in subsonic flight, and in driving engagement with a rotatable load, which is depicted as a propeller 12. The gas turbine engine has in serial flow communication a compressor section 14 for pressurizing the air, a combustor 16 in which the compressed air is mixed with fuel and ignited for generating an annular stream of hot combustion gases, and a turbine section 18 for extracting energy from the combustion gases.

It should be noted that the terms "upstream" and "downstream" used herein refer to the direction of an air/gas flow passing through an annular gaspath 20 of the gas turbine engine 10. It should also be noted that the term "axial", "radial", "angular" and "circumferential" are used with respect to a central axis 11 of the gaspath 20, which may also be a central axis of gas turbine engine 10. The gas turbine engine 10 is depicted as a reverse-flow engine in which the air flows in the annular gaspath 20 from a rear of the engine 10 to a front of the engine 10 relative to a direction of travel T of the engine 10. This is opposite than a through-flow engine in which the air flows within the gaspath 20 in a direction opposite the direction of travel T, from the front of the engine towards the rear of the engine 10. The principles of the present disclosure can be applied to both reverse-flow and through flow engines and to any other gas turbine engines, such as a turbofan engine and a turboprop engine.

Figure 2:
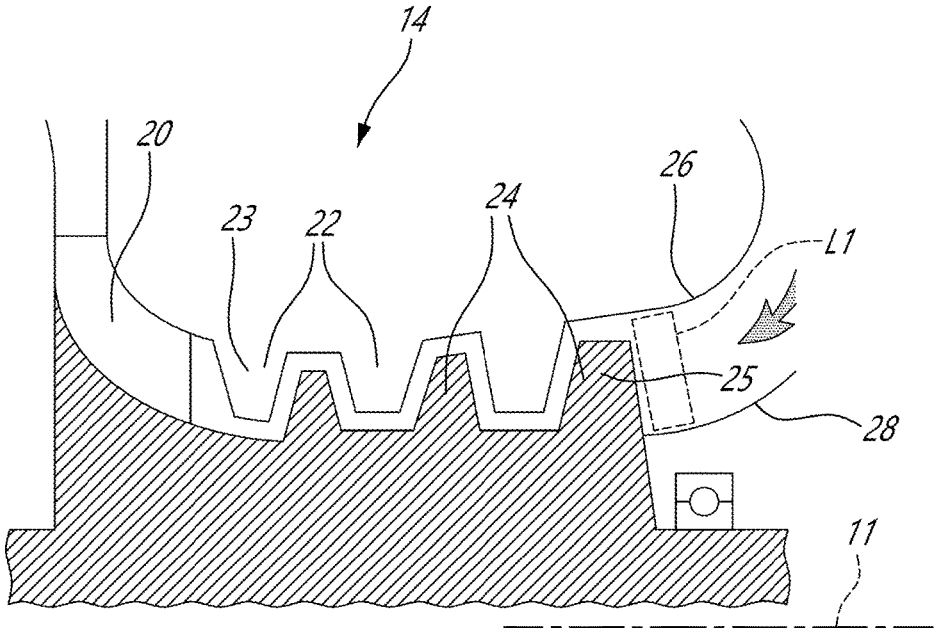
FIG. 2 is an enlarged view of a portion of FIG. 1.

Referring now to FIG. 2, an enlarged view of a portion of the compressor section 14 is shown. The compressor section 14 includes a plurality of stages, namely three in the embodiment shown although more or less than three stages is contemplated, each stage including a stator 22 and a rotor 24. The rotors 24 are rotatable relative to the stators 22 about the central axis 11. Each of the stators 22 includes a plurality of vanes 23 circumferentially distributed about the central axis 11 and extending into the gaspath 20. Each of the rotors 24 also includes a plurality of blades 25 circumferentially distributed around the central axis 11 and extending into the gaspath 20, the rotors 24 and thus the blades 25 thereof rotating about the central axis 11. As will be seen in further detail below, at least one of the stators 22 includes vanes 23 which are variable guide vanes (VGVs) and thus includes a variable guide vane assembly 40 as will be described.

In the depicted embodiment, the gaspath 20 is defined radially between an outer wall or casing 26 and an inner wall or casing 28. The vanes 23 and the blades 25 extend radially relative to the central axis 11 between the outer and inner casings 26, 28. "Extending radially" as used herein does not necessarily imply extending perfectly radially along a ray perfectly perpendicular to the central axis 11, but is intended to encompass a direction of extension that has a radial component relative to the central axis 11. The vanes 23 can be fixed orientation or variable orientation guide vanes (referred hereinafter as VGVs). Examples of rotors include fans, compressor rotors (e.g. impellers), and turbine rotors (e.g. those downstream of the combustion chamber).

Figure 3:
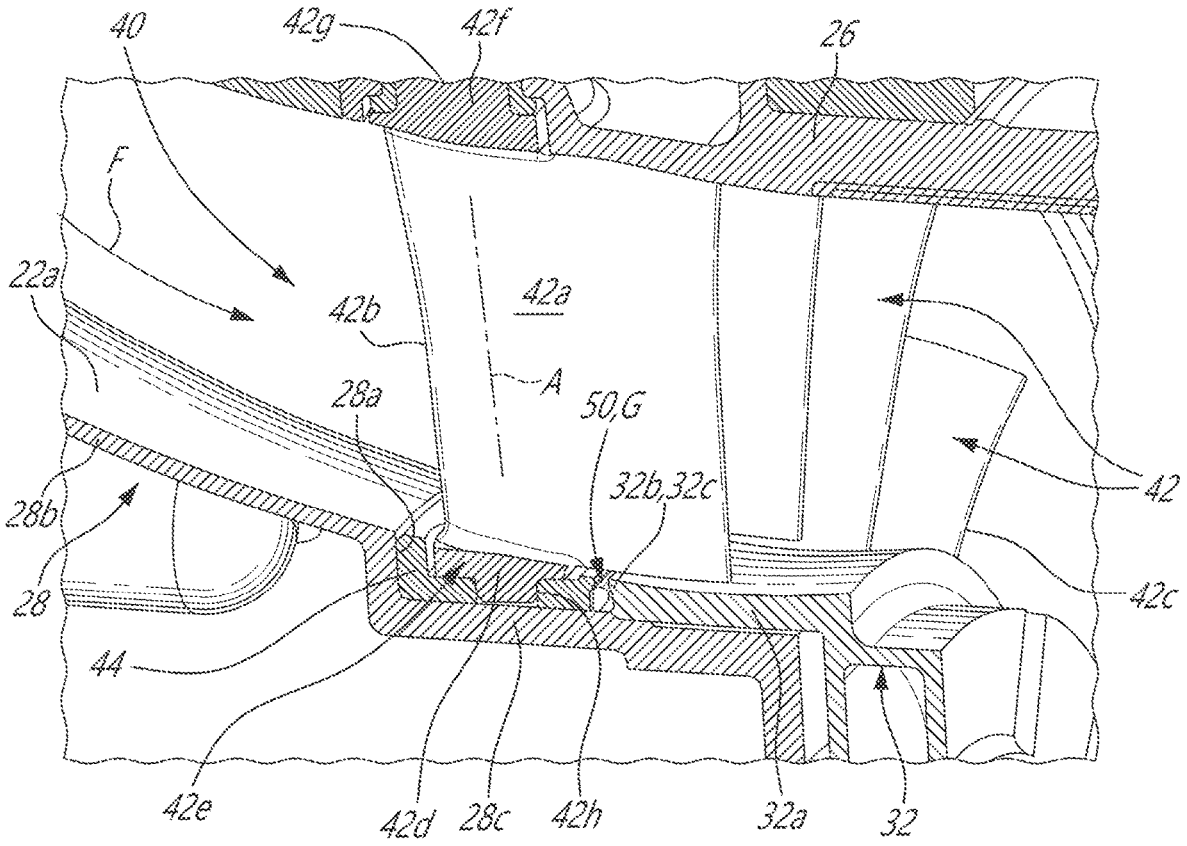
FIG. 3 is a three-dimensional cutaway view of a variable guide vane (VGV) assembly in accordance with one embodiment that is part of the engine of FIG. 1.

Referring to FIG. 3, an example of a variable guide vane (VGV) assembly of a stator 22 of the engine 10 is shown at 40. Any of the stators 22 of the compressor section 14 depicted in FIG. 2 may be embodied as a variable guide vane 40. It will be appreciated that, in some cases, the VGV assembly 40 may be used as a stator of the turbine section 18 of the engine 10 without departing from the scope of the present disclosure. The VGV assembly 40 may be located at an upstream most location L1 (FIG. 2) of the compressor section 14. That is, the VGV assembly 40 may be a variable inlet guide vane assembly located at an inlet of the compressor section 14.

The VGV assembly 40 includes a plurality of vanes 42 circumferentially distributed about the central axis 11 and extending radially between the inner casing 28 and the outer casing 26. In the present embodiment, the vanes 42 are rotatably supported at both of their ends by the inner and outer casings 28, 26. Particularly, each of the vanes 42 has an airfoil **42*a* having a leading edge 42*b* and a trailing edge 42*c* both extending along a span of the airfoil 42*a*. Each of the vanes 42 has an inner stem, also referred to as an inner shaft portion, 42*d* secured to an inner end 42*e* of the airfoil 42*a* and an outer stem, also referred to as an outer shaft portion, 42*f* secured to an outer end 42*g* of the airfoil 42*a***.

In the embodiment shown, an inner gaspath surface **22*a* defining a radially inner boundary of the annular gaspath 22 is defined by a plurality of components axially disposed along the central axis 11 and circumferentially extending around the central axis 11. Particularly, in the embodiment shown, the plurality of components that define the inner gaspath surface 22*a* includes the inner casing 28 and a seal housing 32 of the gas turbine engine 10. Each of those components has a wall defining a respective one of a first gaspath surface portion and a second gaspath surface portion of the inner gaspath surface 22***a*.

Figure 4:
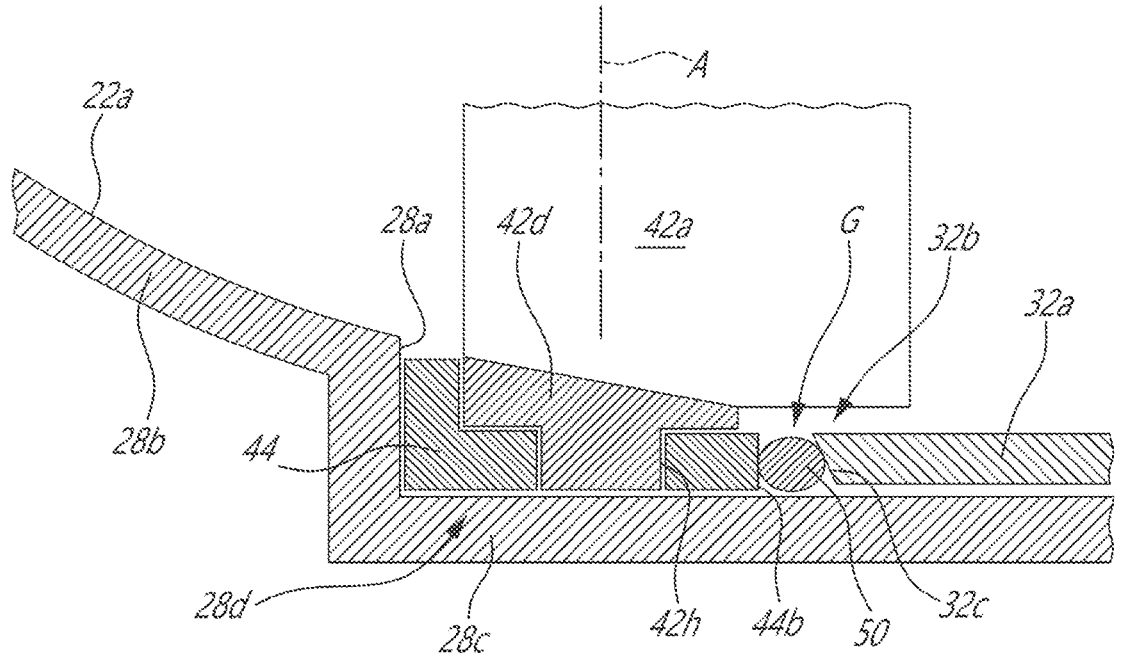
FIG. 4 is an enlarged plan view of a portion of FIG. 3.

Referring to FIGS. 3-4, the inner casing 28 has first and second sections 28*b*, 28*c* of different diameters and a shoulder 28*a* at an intersection between those first and second sections 28*b*, 28*c*. The second section 28*c* has a diameter less than that of the first section 28*b*. The first section 28*b* of the inner casing 28 defines the first gaspath surface portion of the inner gaspath surface 22*a*. The shoulder 28*a* defines an abutment surface extending all around the central axis 11 and facing a direction having an axial component relative to the central axis 11. The seal housing 32 has a wall 32*a* that axially overlaps a portion of the second section 28*c* of the inner casing 28. The wall 32*a* of the seal housing 32 defines the second gaspath surface portion of the inner gaspath surface 22*a*. In the embodiment shown, the first and second gaspath surface portions are spaced apart from one another by an annular recess 28*d* defined by the inner casing 28*b*.

In the embodiment shown, the inner stem 42*d* of the vanes 42 is rotatably engaged within a bushing ring 44. The bushing ring 44 extends circumferentially around the central axis 11 and defines a third portion of the inner gaspath surface 22*a* of the annular gaspath 22. The bushing ring 44 is located axially between the shoulder 28*a* defined by the inner casing 28 and the wall 32*a* of a seal housing 32, which is secured to the inner casing 28. The inner gaspath surface 22*a* of the annular gaspath 22 is defined conjointly by the inner casing 28, the bushing ring 44, and the wall 32*a* of the seal housing 32. A similar bushing ring may be used to rotatably support the outer stems 42*f* of the vanes 42.

The outer stems 42*f* of the vanes 42 may be engaged by a unison ring and the unison ring may be engaged by an actuator such that powering the actuator results in each of the vanes 42 rotating about their respective pivot axes A to change an angle of attack defined between the vanes 42 and a flow F in the annular gaspath 22. Examples of system to rotate the vanes 42 are described in U.S. patent application Ser. No. 16/543,897 filed on Aug. 19, 2019 and Ser. No. 16/885,846 filed on May 28, 2020, the entire contents of which are incorporated herein by reference.

Figure 5:
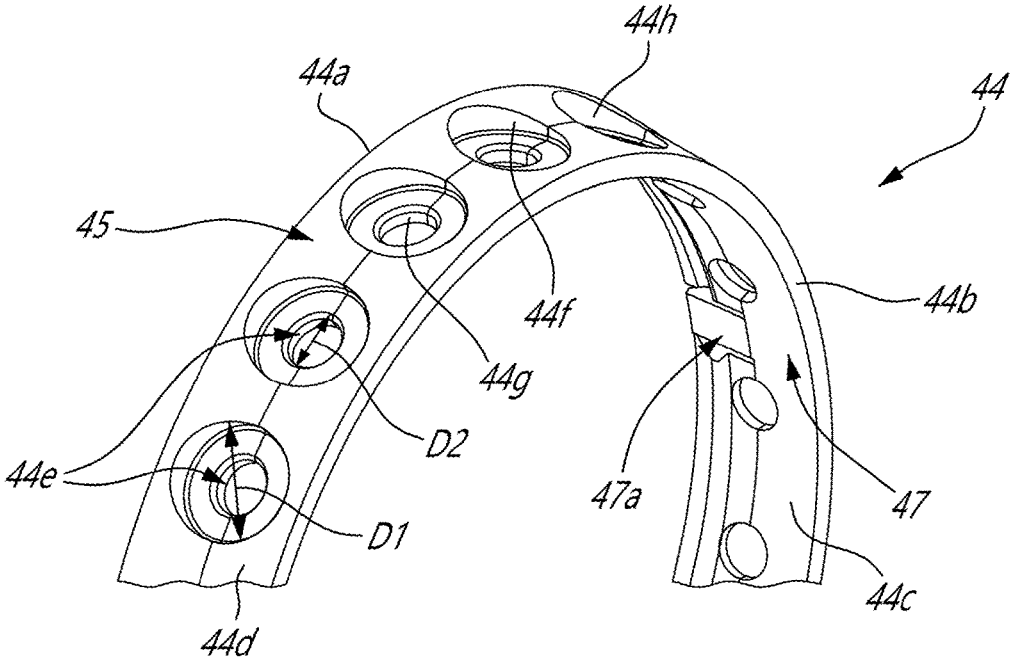
FIG. 5 is a three-dimensional view of a bushing ring of the VGV assembly of FIG. 3.

Referring now to FIG. 5, the bushing ring 44 is shown in greater detail. The main function of the bushing ring 44 is to secure the inner stems 42*d* of the vanes 42, also referred to as stems, in place. In some embodiments of engines, assembly constraints require the bushing ring 44 to be made as two separate components, and joined together in the engine.

In the embodiment shown, the bushing ring 44 includes a first ring body portion 45 and a second ring body portion 47 securable to the first ring body portion 45. In the embodiment shown, the first and second ring body portions 45, 47 are sized and cooperate to house the inner stems 42*d* of the vanes 42. It will be appreciated that the bushing 44 may be located at any suitable location and may be used to house the outer stems 42*f*.

In the depicted embodiment, the busing ring 44 includes a first axial face 44*a* defined by the first ring body portion 45, a second axial face 44*b* opposed the first axial face 44*a* and defined by the second ring body portion 47, a radially inner face 44*c* defined by both of the first and second ring body portions 45, 47 and oriented toward the central axis 11, and a radially outer face 44*d* defined by both of the first and second ring body portions 45, 47 and oriented away from the central axis 11. Both of the radially inner and radially outer faces 44*c*, 44*d* of the bushing ring 44 extends axially from the first axial face 44*a* to the second axial face 44*b*.

Still referring to FIG. 5, the bushing ring 44 defines a plurality of stem pockets 44*e* circumferentially distributed about the central axis 11 of the engine 10. Each of these pockets 44*a* includes a first pocket portion 44*f* having a first diameter D1 and extending from the radially outer face 44*d* toward the radially inner face 44*c*, and a second pocket portion 44*g* having a second diameter D2 less than the first diameter D1 and extending from the first pocket portion 44*f* to the radially inner face 44*c*. Each of the first and second pocket portions 44*f*, 44*g* are sized to receive respective portions of the inner stems 42*d* of the vanes 42. In the present embodiment, peripheral surfaces 42*h* of the inner stems 42*d* of the vanes are in direct contact with peripheral surfaces 44*h* of the ring 44 that define the pockets 44*e*. Each of these peripheral surfaces 44*h* of the pockets 44*e* extends circumferentially around respective vane pivot axis A (FIG. 3) of the vanes 42. Using the disclosed bushing ring 44 may allow the omission of separate bushings disposed around each of the stems 42*d* of the vanes 42. This may reduce part count and weight.

The first and second ring body portions 45, 47 may be made of any suitable material including, but not limited to, compression molded composite, such as, for instance, polyamide with a carbon filler (e.g., 40% carbon filler). The first and second ring body portions 45, 47 may be then machined as a set to create the vane pockets 44*e* and a surface defining a portion of the gaspath surface 22*a* of the gaspath 22. Manufacturing the bushing ring 44 in this sequence may ensure that each set of parts has acceptable tolerance.

As illustrated in FIG. 5, each of the first and second ring body portions 45, 47 define a portion (e.g., half) of the circumference of the pockets 44*e*. That is, the peripheral surfaces 44*h* extending around the pockets 44*e* are conjointly defined by the first ring body portion 45 and by the second ring body portion 47. Each of the first and second pocket portions 44*f*, 44*g* is defined concurrently by the first ring body portion 45 and by the second ring body portion 47.

Referring to FIG. 4, the bushing ring 44 is received within the annular recess 28*d* and is sized to fit axially between the shoulder 28*a* of the inner casing 28 and the wall 32*a* of the seal housing 32. In the present embodiment, the disclosed bushing ring 44 is received axially between an inter-compressor case portion of the inner casing 28 and the seal housing 32. The radially outer face 44*d* has a shape configured to bridge a gap between the shoulder 28*a* of the inner casing 28 and the wall 32*a* of the seal housing 32. In other words, the radially outer face 44*d* defines a third portion of the inner gaspath surface 22*a* of the gaspath 22 of the engine 10.

The plurality of components of the gas turbine engine 10 are stacked up axially along the central axis 11. Each of those components are manufactured with specific tolerances. In some cases, tight tolerances are required to ensure that the bushing ring 44 fits tightly between the inter-compressor case portion of the inner casing 28 and the seal housing 32. Obtaining these tolerances may be challenging in some cases. These tight tolerances may ensure that no axial movement occur between the bushing ring 44 and the cavity it sits in.

In the embodiment shown in FIG. 3, a biasing member 50 is received within the annular recess 28*d* and is used to fill a gap G between either the shoulder 28*a* defined by the inner casing 28 and the bushing ring 44 or, as shown in FIG. 4, between the wall 32*a* of the seal housing 32 and the bushing ring 44. In the embodiment shown, the biasing member 50 is disposed axially between the second axial face 44*b* of the bushing ring 44 and the wall 32*a* of the seal housing 32. In the present case, the biasing member 50 is located downstream of the bushing ring 44 relative to a direction of an airflow F within the annular gaspath 22. In the present embodiment, the biasing member 50 is a sealing member, in the present case, a U-seal. The biasing member 50 may be made of an elastomeric material. The biasing member 50 may be made of a metallic seal shape. In operation, the loads on the vanes pushes them forward. Having the biasing member 50 located downstream of the bushing ring 44 may allow to have a fixed wall at the front to keep the vane assembly fix. The biasing member 50 may take up tolerance slack and may seal against leakage and may ensure that the shroud doesn't move back when the engine is shut down.

The biasing member 50 is used to secure the bushing ring 44 in place by limiting axial motion of the bushing ring 44 relative to the central axis 11. A pin or other means may be used to limit rotation of the bushing ring 44. The use of the biasing member 50 may have the additional benefit of acting as a damper to account for the stack up range in the region between the inner casing 28 and the seal housing 32. The seal member 50 is compressed in the gap G between the wall 32*a* of the seal housing 32 and the bushing ring 44. In other words, the biasing member 50 has an at-rest, uncompressed, state, a thickness of the biasing member 50 in the at-rest, uncompressed, state and along the central axis 11 is greater than an axial width of the gap G relative to the central axis 11.

In the illustrated embodiment, the biasing member 50 is in abutment against an end face 32*c* defined by a distal end 32*b* of the wall 32*a* of the seal housing 32. The end face 32*c* extends around the central axis 11 and slopes such that the gap G widens in a radial direction relative to the central axis and toward the central axis 11 and away from the annular gaspath 22. In other words, the end face 32*c* slopes away from the bushing ring 44 in a radial direction away from the annular gaspath 22. The gaps G expands in a direction extending radially away from the inner gaspath surface 22*a*. This may help in maintaining the biasing member 50 in the gap G when the biasing member 50 is compressed.

The biasing member 50 exerts a force against the bushing ring 44 in an axial direction relative to the central axis 11 and towards the shoulder 28*a* of the inner casing 28. In other words, the biasing member 50 pushes the bushing ring 44 away from the wall 32*a* of the seal housing 32. Stated differently, the biasing member 50 may exert a reaction force when compressed between a certain range of displacements. The biasing member 50 may be used to accept the entire stack up range for a spacing between the inner casing 28, more particularly the shoulder 28*a* of the inner casing 28, and seal housing 32, more particularly the wall 32*a* of the seal housing 32 that defines a portion of the gaspath surface 22*a*. In the depicted embodiment, an axial length of the biasing member 50 relative to the central axis 11 is greater than a largest gap between the shoulder 28*a* and the distal end of the wall 32*a* of the seal housing 32 so that in the worst tolerance condition, the biasing member 50 remains compressed and thus exerts a force against the components axially compressing it. The force exerted by the biasing member 50 when it is compressed may also be used to press the two body portions 45, 47 of the bushing ring 44 together and axially against the inter-compressor case.

The disclosed embodiment using the biasing member 50 may require less control on the surrounding component's tolerances by instead using the expansion properties of the biasing member 50 in order to accommodate any axial gap present (FIG. 5). Savings may be made at the manufacturing stage because of the use of those less strict tolerances.

Figure 6:
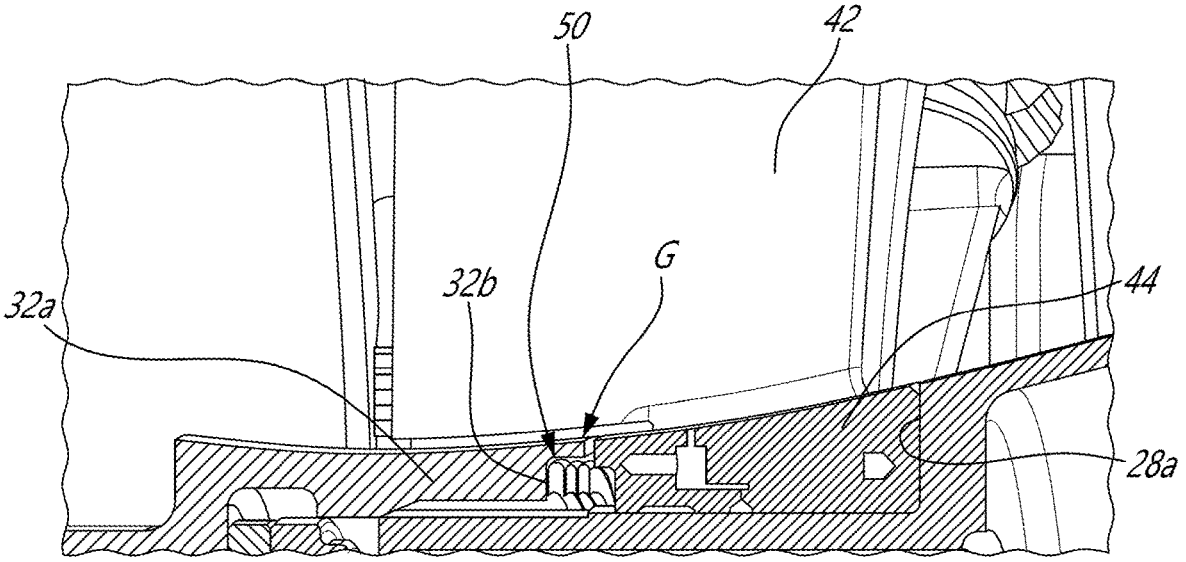
FIG. 6 is a three-dimensional cutaway view of a VGV assembly in accordance with another embodiment.

Referring now to FIG. 6, the biasing member 50 is shown here as a W seal. The W seal is located axially between the distal end 32*b* of the wall 32*a* of the seal housing 32 and the bushing ring 44. Other locations of the biasing member 50 are contemplated. For instance, it may be located between the shoulder 28*a* defined by the inner casing 28 and the bushing ring 44.

The biasing member 50 may be used to dampen vibration of the engine 10. That is, the airflow F may be flown in the annular gaspath 22 and redirected by changing the angle of attack of the vanes 42. These change in flow direction may induce turbulence and vibrations. The biasing member 50 may therefore be deformed to allow axial movements between the inner casing 28 and the seal housing 32 thereby damping some of those vibrations.

It will be appreciated that any means able to exert an axial force against the bushing ring 44 as explained herein above may be used without departing from the scope of the present disclosure. For instance, the biasing member may be a spring, such as a wave spring, an elastomer, etc. The biasing member may include a plurality of springs distributed within the gap G and circumferential interspaced around the central axis 11. Any suitable biasing member may be used. An expanded foam (EPS) material may be used for the biasing member.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, other applications of the present disclosure may include using the axial seal as a method to fasten a multi-piece VGV inner ring together. This may be especially useful for environments where space is limited, and assembly may be made easier by using a multi-piece inner ring to be assembled in the engine rather than on a bench. Moreover, the disclosed bushing ring and biasing member may be located radially outwardly of the annular gaspath relative to the central axis of the gas turbine engine. Yet further modifications could be implemented by a person of ordinary skill in the art in view of the present disclosure, which modifications would be within the scope of the present technology.

The invention claimed is:

1. A gas turbine engine comprising: a first component and a second component defining a respective first gaspath surface and a second gaspath surface of an annular gaspath extending circumferentially around a central axis, the first and second gaspath surfaces axially spaced apart from one another by an annular recess in the first component; a bushing ring disposed within the annular recess and defining stem pockets therein, the stem pockets circumferentially distributed about the central axis; variable guide vanes circumferentially distributed about the central axis, the variable guide vanes having airfoils extending across the annular gaspath, the variable guide vanes having first and second stems located at first and second radial ends of the airfoils, the first stems rotatably engaged within the stem pockets in the bushing ring, the variable guide vanes pivotable about respective vane axes extending between the first and second stems; and a biasing member received within the annular recess and disposed axially between the bushing ring and one of the first component and the second component, the biasing member exerting a force against the bushing ring in an axial direction relative to the central axis and towards the other of the first component and the second component, the biasing member having an uncompressed state and a compressed state, a thickness of the biasing member in the uncompressed state being greater than an axial width of the annular recess.

2. The gas turbine engine of claim 1, wherein the biasing member is a sealing member.

3. The gas turbine engine of claim 2, wherein the sealing member extends circumferentially all around the central axis.

4. The gas turbine engine of claim 2, wherein the biasing member is a U-seal.

5. The gas turbine engine of claim 2, wherein the biasing member is a W-seal.

6. The gas turbine engine of claim 2, wherein the sealing member is made of an elastomeric material.

7. The gas turbine engine of claim 1, wherein the bushing ring has two body portions biased in engagement against one another via the biasing member.

8. The gas turbine engine of claim 1, wherein the first and second gaspath surfaces are disposed on a radially inner annular surface of the annular gas path.

9. The gas turbine engine of claim 8, wherein the first component is an inner casing of the gas turbine engine and wherein the second component is a wall of a seal housing of the gas turbine engine.

10. The gas turbine engine of claim 9, wherein the annular recess is defined by a first section of the inner casing having a diameter less than that of a second section of the inner casing, a shoulder at an intersection between the first section and the second section, the bushing ring in abutment against the shoulder.

11. The gas turbine engine of claim 10, wherein the biasing member is located axially between the bushing ring and a distal end of the wall of the seal housing.

12. The gas turbine engine of claim 10, wherein the wall of the seal housing axially overlaps the first section of the inner casing.

13. The gas turbine engine of claim 11, wherein the distal end of the wall of the seal housing defines a face extending around the central axis and facing the biasing member, the face sloping away from the bushing ring in a radial direction away from the annular gaspath.

14. The gas turbine engine of claim 1, wherein the variable guide vanes are located within a compressor of the gas turbine engine.

15. The gas turbine engine of claim 14, wherein the variable guide vanes are located at an inlet of the compressor.

16. The gas turbine engine of claim 1, wherein the biasing member is located downstream of the bushing ring relative to a flow direction in the annular gaspath.

17. The gas turbine engine of claim 1, wherein the bushing ring defines a third gaspath surface, the first, second and third second gaspath surfaces collectively defining an annular surface of the annular gaspath.

18. A gas turbine engine comprising:

a first component and a second component defining a respective first gaspath surface and a second gaspath surface of an annular gaspath extending circumferentially around a central axis, the first and second gaspath surfaces axially spaced apart from one another by an annular recess in the first component;

a bushing ring disposed within the annular recess and defining stem pockets therein, the stem pockets circumferentially distributed about the central axis;

variable guide vanes circumferentially distributed about the central axis, the variable guide vanes having airfoils extending across the annular gaspath, the variable guide vanes having first and second stems located at first and second radial ends of the airfoils, the first stems rotatably engaged within the stem pockets in the bushing ring, the variable guide vanes pivotable about respective vane axes extending between the first and second stems; and means for exerting a force against the bushing ring in an axial direction relative to the central axis, the means able to exert a reaction force against the bushing ring in reaction to a compression force.

19. The gas turbine engine of claim 18, wherein the means include an elastomeric sealing member received within the annular recess, the elastomeric sealing member located between the bushing ring and one of the first component and the second component.

20. A gas turbine engine comprising: an annular gaspath extending circumferentially around a central axis, the annular gaspath defined radially between a first gaspath surface and a second gaspath surface; two walls defining a portion of the first gaspath surface, the two walls axially spaced apart from one another by a spacing; a stator having vanes circumferentially distributed about a central axis, the vanes having airfoils extending across the annular gaspath, the vanes having first and second stems secured to first and second radial ends of the airfoils, the vanes pivotable about respective vane axes extending between the first and second stems a bushing ring radially supported by one or both of the two walls within the spacing between the two walls, the bushing ring defining pockets receiving the first stems of the vanes, the bushing ring rotatably supporting the first stems of the vanes; and a biasing member received within a gap between the bushing ring and one of the two walls, the biasing member axially compressed between the bushing ring and the one of the two walls, the biasing member having an uncompressed state and a compressed state, a thickness of the biasing member in the uncompressed state being greater than an axial width of the gap.

* * * * *